US008167034B2

(12) United States Patent
Castro

(10) Patent No.: US 8,167,034 B2
(45) Date of Patent: May 1, 2012

(54) DEVICE FOR CENTERING A WELL CASING

(75) Inventor: Mynor J. Castro, Chandler, AZ (US)

(73) Assignee: Offshore Manufacturing & Design, LLC, Chandler, AZ (US)

( * ) Notice: Subject to any disclaimer, the term of this patent is extended or adjusted under 35 U.S.C. 154(b) by 120 days.

(21) Appl. No.: 12/142,736

(22) Filed: Jun. 19, 2008

(65) Prior Publication Data

US 2009/0314486 A1 Dec. 24, 2009

(51) Int. Cl.
*E21B 17/10* (2006.01)

(52) U.S. Cl. ..... 166/241.6; 175/325.5

(58) Field of Classification Search ..... 166/241.6; 175/325.5
See application file for complete search history.

(56) References Cited

U.S. PATENT DOCUMENTS 1,807,050 A * 5/1931 Stolz ..... 166/285
2,722,462 A * 11/1955 Tschirley ..... 175/325.5
5,542,454 A * 8/1996 Carlson et al. ..... 138/110
5,566,754 A * 10/1996 Stokka ..... 166/241.6
5,979,508 A * 11/1999 Cherrington ..... 138/108
6,006,830 A * 12/1999 Barron et al. ..... 166/241.6
6,435,275 B1 * 8/2002 Kirk et al. ..... 166/241.1
6,666,267 B1 * 12/2003 Charlton ..... 166/241.6
6,830,102 B2 * 12/2004 Kirk et al. ..... 166/241.6
6,845,816 B2 * 1/2005 Kirk et al. ..... 166/241.6
7,159,668 B2 * 1/2007 Herrera ..... 166/381
7,409,758 B2 * 8/2008 Le et al. ..... 29/421.1
7,814,633 B2 * 10/2010 Slack ..... 29/421.1
2002/0023749 A1 * 2/2002 Kirk et al. ..... 166/241.1
2003/0106719 A1 * 6/2003 Herrera ..... 175/325.2
2006/0231250 A1 10/2006 Slack
2008/0164019 A1 * 7/2008 Angman ..... 166/241.6
2009/0314486 A1 * 12/2009 Castro ..... 166/241.6

* cited by examiner

*Primary Examiner* — Jennifer H Gay
(74) *Attorney, Agent, or Firm* — Perkins Coie LLP

(57) ABSTRACT

A device (100, 200) is for centering a drill casing (7) within a wellbore (3). The device (100, 200) includes a generally tubular body (9) having an outer surface (11) facing the wellbore (3). A plurality of protrusions (4) is disposed on the outer surface (11) along a line (6). A gap region between the protrusions (4) along the line (4).

20 Claims, 5 Drawing Sheets

DEVICE FOR CENTERING A WELL CASING

BACKGROUND OF THE INVENTION

The present invention relates, in general, to centering a pipe and, more particularly, to centering a casing within a wellbore.

A wellbore is the physical hole that makes up a well and can be open or cased, or a combination of both, and can extend miles deep within the earth. The wellbore can be routed vertically or horizontally with respect to the above surface. Further, the wellbore can be routed through a variety of strata or layers containing valuable water and natural gas sources. After the wellbore is completed, a well casing is typically inserted into the wellbore. The well casing is inserted into the wellbore to prevent collapsing of the wellbore, to prevent cross-contamination between the earth's various layers and to provide a pressure boundary for the well.

After installing the casing in the well, cement is typically pumped into an annular space between the casing and the drilled hole or wellbore. Once hardened, cement prevents fluid flow between strata of the earth and allows selective production from zones of interest, typically oil and gas. Proper cement placement requires that the casing is centralized in the well bore to ensure uniform annular space. Centralizers are used to keep a uniform annular space between the wellbore and the casing. This is achieved by protrusions disposed on the outside of the centralizer. To keep the casing centered within the wellbore, the position and shape of the protrusions are important to maintain the appropriate orientation of the casing and minimizing annular volume restrictions and drag forces while installing the casing in the wellbore.

During installation of the well casing, the protrusions can be exposed to rigorous forces including rotational or axial movement on the centralizer. Hence, the protrusions of the centralizer need to be strong to prevent breakage from stresses during installation and from subsequent drilling.

Hence, there is a need for a centralizer having improved protrusions to help prevent cement voids and have sufficient strength to prevent breakage.

SUMMARY OF THE INVENTION

The present invention satisfies the foregoing need to provide a device referred to as a centralizer, which can be used to center a well casing within a wellbore. The centralizer is a generally tubular body having an outer surface for facing the wellbore. The outer surface includes a plurality of protrusions, which are generally positioned along a line. On the outer surface, the centralizer further includes a gap region that is disposed between adjacent protrusions along the line. The plurality of protrusions is formed using hydroforming.

DETAILED DESCRIPTION OF THE DRAWINGS

The present invention will be better understood from a reading of the following detailed description, taken in conjunction, with the accompanying drawing figures, in which like reference numbers designate like elements and in which:

Generally, the present invention is an improved centralizer including structure for improving the flow of a sealer around the centralizer on installation within a wellbore. This is accomplished by providing a gap region between adjacent protrusions of a plurality of protrusions disposed along a line. A sealer, referred to as cement, can freely flow between adjacent protrusions, thereby reducing the opportunity of void formations in the cement. Further, the installation strength of the centralizer is improved. In contrast to providing a single protrusion over nearly the entire length of the centralizer, a plurality of protrusions along a line is provided. This enables each protrusion more strength compared to a single long protrusion, because each protrusion includes an end portion on each end. The end portions can be rounded to reduce stresses and reduce catching onto at least earth structures within the wellbore. Further yet, the strength on installation of the centralizer is generally improved. In making the centralizer hydroforming can be used. Hydroforming typically causes portions of the protrusion walls to be thinned. In particular, the wall at the top of the protrusion can be thinned, thereby reducing the protrusion strength. On installation of the centralizer, cement fills the space over the gap region and between the protrusions. This can provide additional support by sharing and relieving a portion of the forces acting on the protrusions. In one embodiment the plurality of protrusions can be capsule shaped. In other embodiments, the plurality of protrusions can have a round shape and the like.

Figure 1:
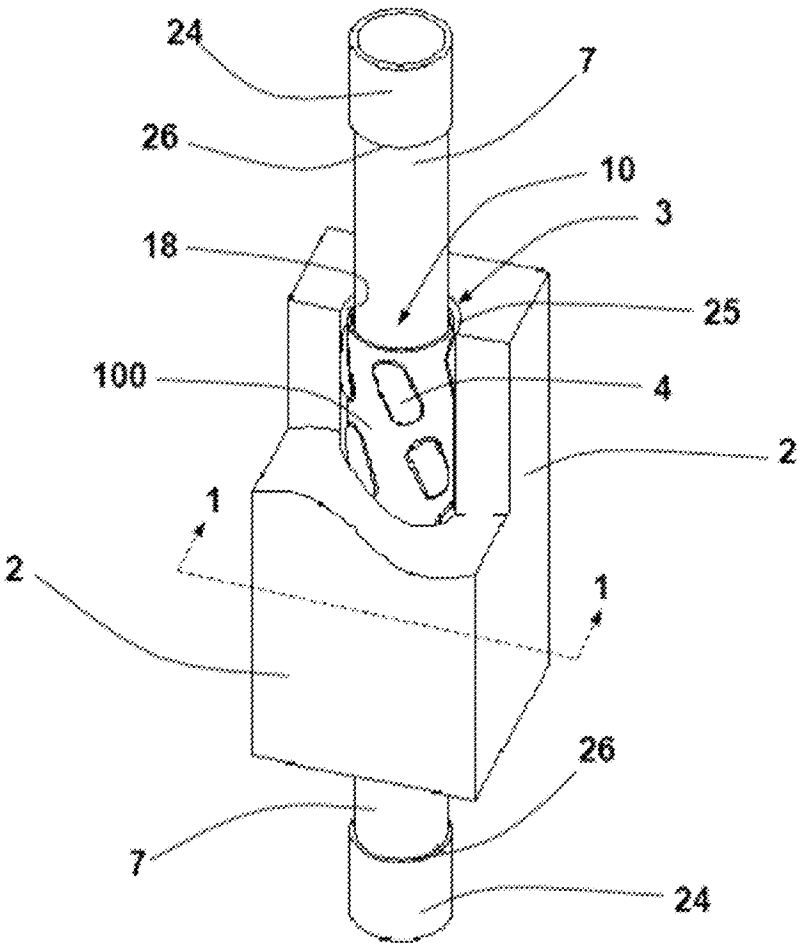
FIG. 1 is perspective view of a centralizer as used in a well.
Figure 3:
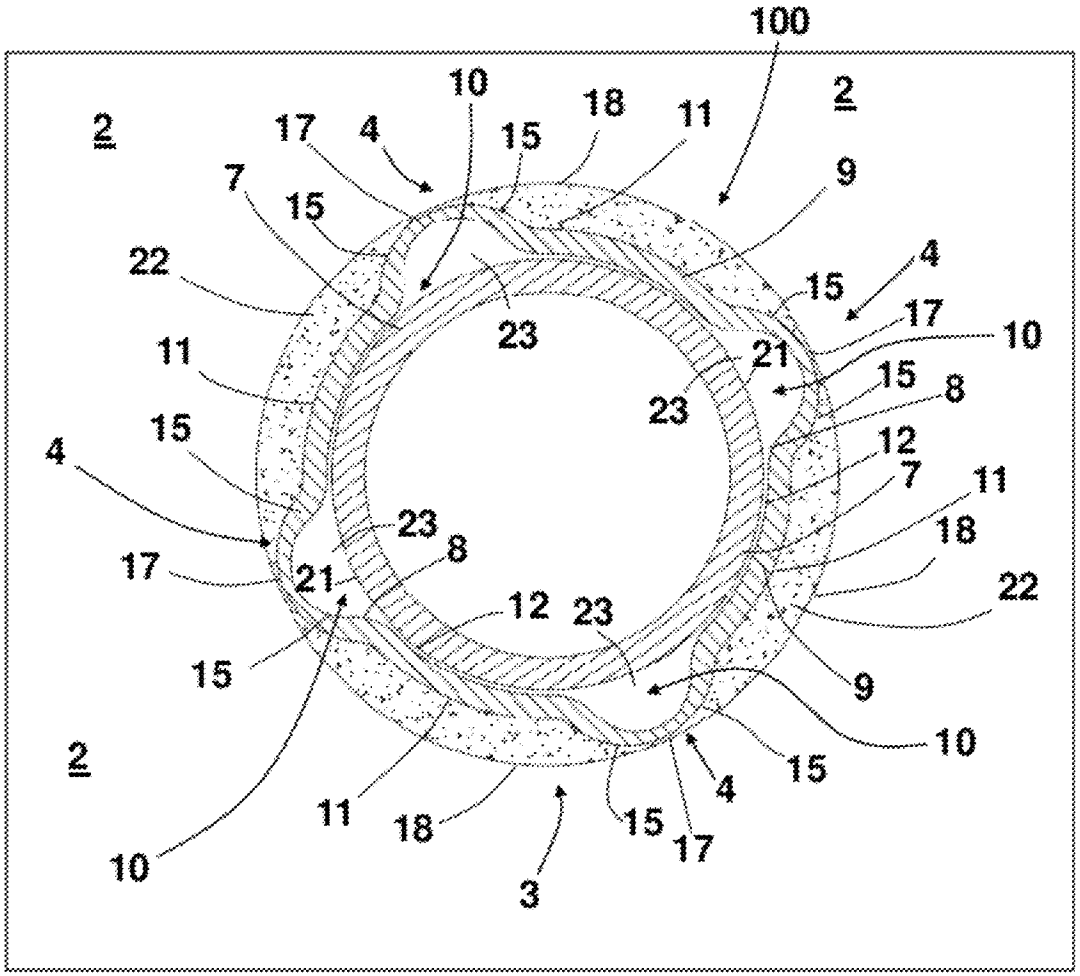
FIG. 3 is a cross sectional view of the centralizer of FIG. 1.

FIG. 1 illustrates a perspective view of a portion of a wellbore 3 penetrating a section of earth 2. A well casing 7 is shown extended into the portion of the wellbore 3 and passes through an inside of a centralizer 100. Here, the inside diameter of the centralizer 100 is larger than the outside diameter of the well casing 7. Hence, the well casing 7 can either rotate or move longitudinally with respect to the centralizer 100. In other embodiments (not shown) the inside diameter of a centralizer can be generally equal to or smaller than the outside diameter of a well casing. The respective diameter of the well casing 7 and centralizer 100 should not be considered a limitation of the present invention. The centralizer 100 is shown positioned between the well casing 7 and a sidewall 18 of the wellbore 3. Typically, the centralizer 100 is anchored in position with a sealer within an annular space 25. The details for anchoring the centralizer 100 in the wellbore 3 are illustrated in FIG. 3. The centralizer 100 can be made of materials including steel or alloys and the like.

FIG. 1 further illustrates a coupling 24 used to connect together a plurality of well casings 7 in order to form a string of well casings 7 along the wellbore 3. The centralizer 100 is normally positioned periodically at locations along the plurality of well casings 7. Normally, an edge 14 (FIG. 2) of the centralizer 100 rests (not shown) or stops on an edge 26 of the coupler 24, which typically has an outer diameter greater than the inner diameter of the centralizer 100.

Figure 2:
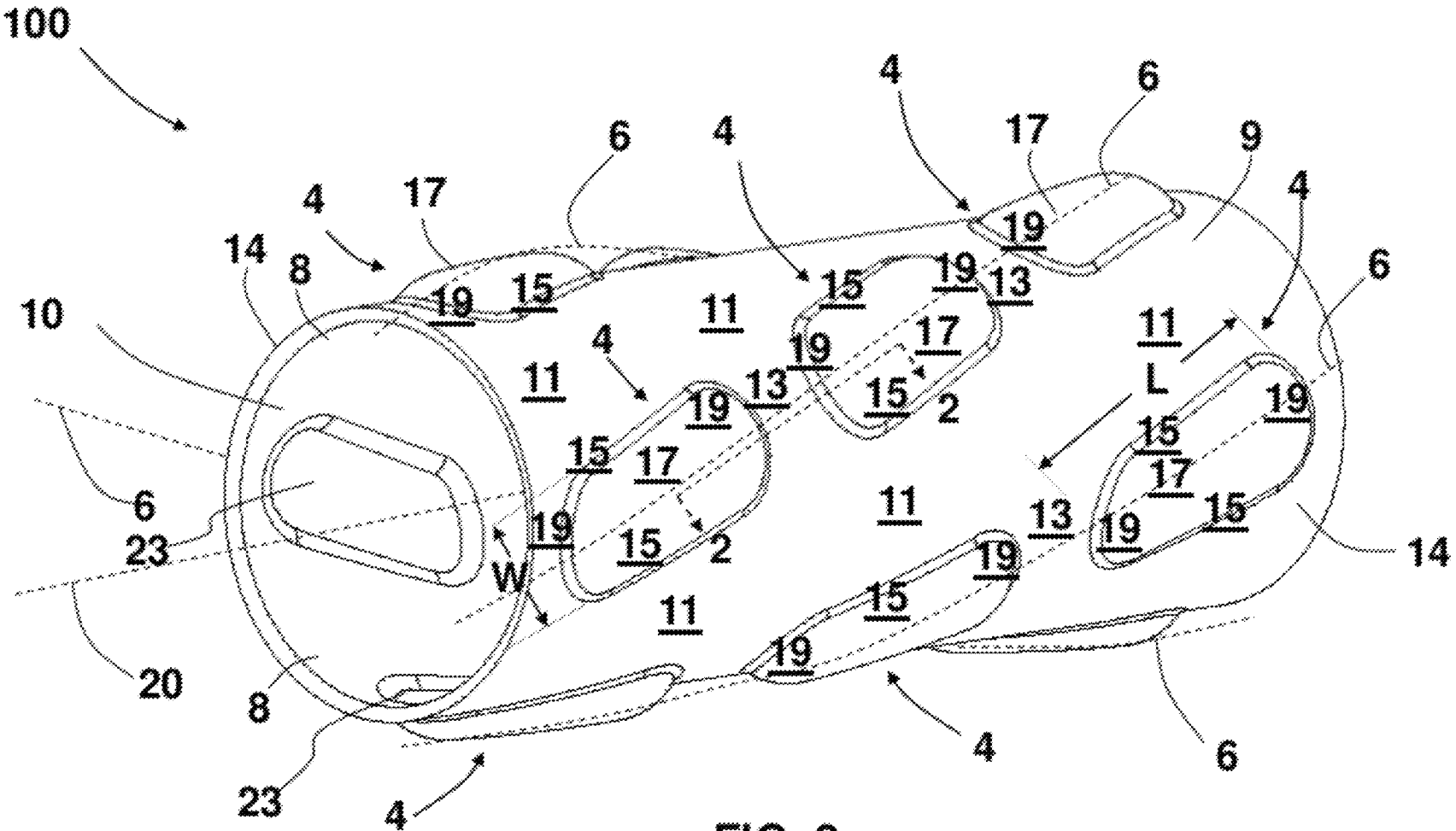
FIG. 2 is a perspective view of the centralizer.

FIG. 2 is a perspective view of the centralizer 100 illustrating a tubular body 9 having a plurality of protrusions 4 formed along a line 6 on an outer surface 11. The number of the plurality of protrusions 4 along the line 6 is shown as three. The number of the plurality of protrusions 4 can be more or less than three and should not be considered a limitation of the present invention. Further, the plurality of protrusions 4 can be located along a plurality of lines 6 along the outer surface 11. Here, the plurality of lines 6 is shown as four. The number of the plurality of lines 6 can be more or less than four and should not be considered a limitation of the present invention. The line 6 as shown can be oblique to a centerline 20 of the tubular body 9. An opening 10 of the tubular body 9 can be used to receive the well casing 7 as shown in FIG. 1. As shown in FIG. 2, the plurality of protrusions 4 extends portions of the outer surface 11 radially outward in four directions. This can provide a generally uniform annular space 25 (FIG. 1) between the outer surface 11 of the centralizer 100 and the sidewall 18 of the wellbore 3. A protrusion of the plurality of protrusions 4 can extend outward from the outer surface 11 a distance ranging but not limited from about ¼ inch to about ½ inch.

A pair of side portions 15 is an expanded portion of the outer surface 11 and disposed on the long side (L), as illustrated in FIG. 2, of any protrusion of the plurality of protrusions 4, which can be made using hydroforming. Hydroforming uses fluids under high pressure to expand portions of the tubular body 9 through openings of a die. The plurality of protrusions 4 and sidewalls referred to as a side portion 15 is formed by pressuring fluid onto portions of the wall of the tubular body 9. As depicted in FIG. 2, an inside wall 8 is opposite the outer surface 11. From the hydroforming process, an indention or cavity 23 as shown is formed on the inside wall 8. Generally, the pair of side portions 15 has a thickness on the order of about 20 percent less than the thickness of the unexpanded portions of the tubular body 9.

Figure 4:
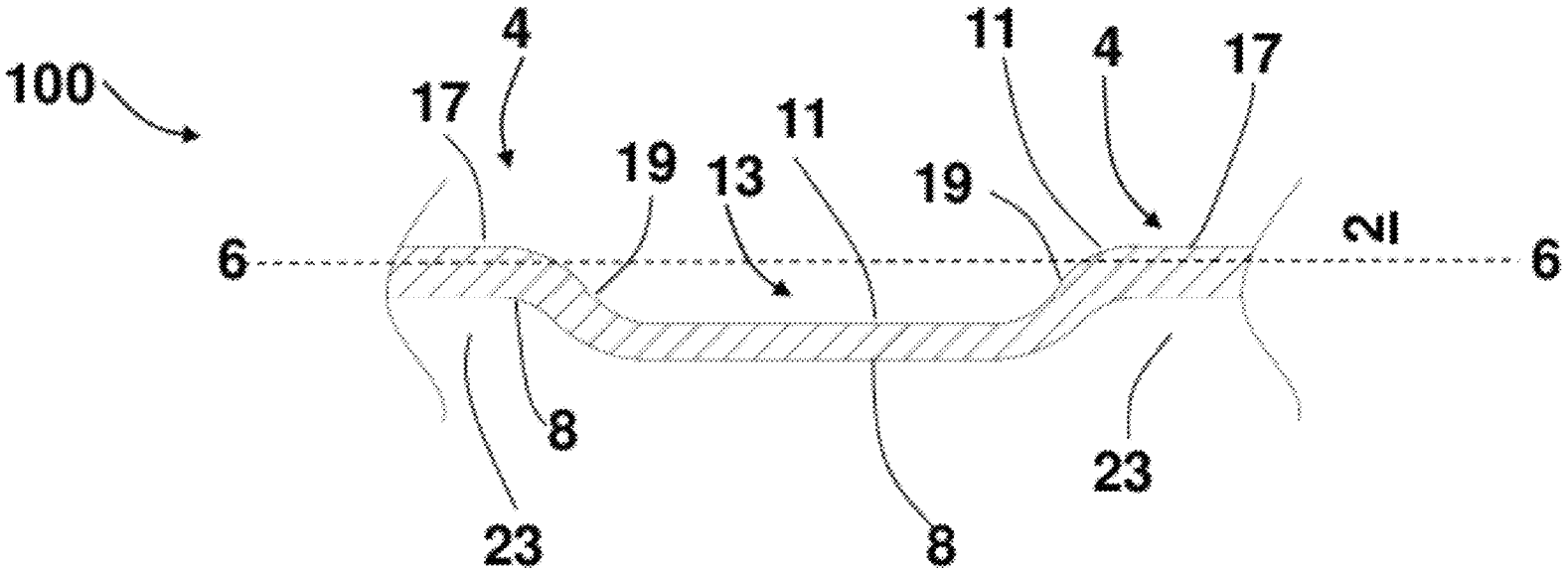
FIG. 4 is a cross sectional view of a portion of FIG. 2.

A gap region 13 includes unexpanded portions of the outer surface 11 and is located between adjacent protrusions 4 along the line 6. The thickness of the underlying wall at the gap region 13 is generally not expanded from hydroforming and is substantially the same as the wall thickness of the unexpanded portions of the tubular body 9. As shown in FIG. 4, on installation of the centralizer 100, the annular space between at least the gap region 13 and the side wall 18 of the wellbore 3 provides a path for cement 22 to flow. Hence, the gap region 13 provides for improved flow of cement 22 and reduces the formation of cement voids.

In FIG. 2, a top portion 17 includes an expanded portion of the outer surface 11 and as shown is generally at the top of any protrusion of the plurality of protrusions 4.

A pair of end portions 19 is an expanded portion of the outer surface 11 and is formed similar to the pair of side portions 15 as mentioned above and has generally the same thickness as the pair of side portions 15. The pair of end portions 19 is formed on each short end (W), as shown in FIG. 2, of a protrusion of the plurality of protrusions 4. The pair of end portions 19 connect between the top portion 17 and the gap region 13, thereby providing further support of the top portion 17 and increasing strength.

As illustrated in FIG. 2, the protrusions 4 are shaped as an outline of generally a stretched circle having parallel sides on the long side. This shape is referred to here as having a capsule-shaped outline or capsule-shaped. The shape of the protrusion 4 can aid the flow of sealer and help prevent snagging and can include dome, paraboloid of revolution, ellipsoid, capsule and the like. The shape of the protrusion 4 should not be considered a limitation of the present invention.

As illustrated in FIG. 2, the line 6 is formed as a spiral. The line 6 along which the plurality of protrusions can be straight, curved, spiral and the like.

FIG. 3 is a cross sectional view from 1-1 of FIG. 1 illustrating the centralizer 100 as installed in a wellbore 3 within the earth 2. As shown, the protrusions of the plurality of protrusions 4 establish centering of the centralizer 100 within the wellbore 3. A sealer material such as cement 22 is disposed within the annular space between the sidewall 18 of the wellbore 3 and the outer surface 11 of the centralizer 100. The drill casing 7 is shown within the centralizer 100. A gap or clearance 12 is illustrated between the inside wall 8 of the centralizer 100 and an outer surface 21 of the well casing 7. A cavity 23 is depicted formed on the inside wall 8 opposite or underlying the protrusion 4 on the outer surface 11. As shown in FIG. 1, any longitudinal movement of the well casing 7 with respect to the centralizer 100 is limited between couplers 24. As shown in FIG. 3, the cement 22 is formed between the plurality of protrusions 4 and can prevent the centralizer 100 from rotating via any applied rotational forces or other forces that could transfer from the well casing 7 to the centralizer 100.

As further illustrated in FIG. 3, the wall of the top portion 17 is the thinnest portion of the plurality of protrusions 4. The side portion 15 extends toward the top portion 17 and is thinner than the unexpanded wall of tubular body 9. The underlying wall thickness of the top portion 17 is relatively thin as compared to other portions of the wall of any protrusion of the plurality of protrusions 4. The top portion 17 typically bears substantial forces acting on the centralizer. For example, the top portion 17 is the point of contact or generally supports the centralizer 100 for the well casing 7 when routed horizontally.

FIG. 4 is a cross sectional view from section 2-2 of FIG. 2 of one side of a portion of the centralizer 100 and illustrates the installation in a wellbore 3. Though not shown, concrete 22 can be disposed between the outer surface 11 and the wellbore 3 (see FIG. 1). Such concrete 22 would be adjacent to the gap region 13 and between the plurality of protrusions 4 along the line 6. The concrete 22 adjacent to the gap regions 13 aids or relieves compression forces acting on the plurality of protrusions 4. As previously mentioned, the wall thickness underlying the top portion 17 is generally thinner than the unexpanded gap region 13. Hence, the concrete 22 between the wellbore 3 (FIG. 1) and the gap region 13 provides additional support for the plurality of protrusion 4 against compression forces.

Figure 5:
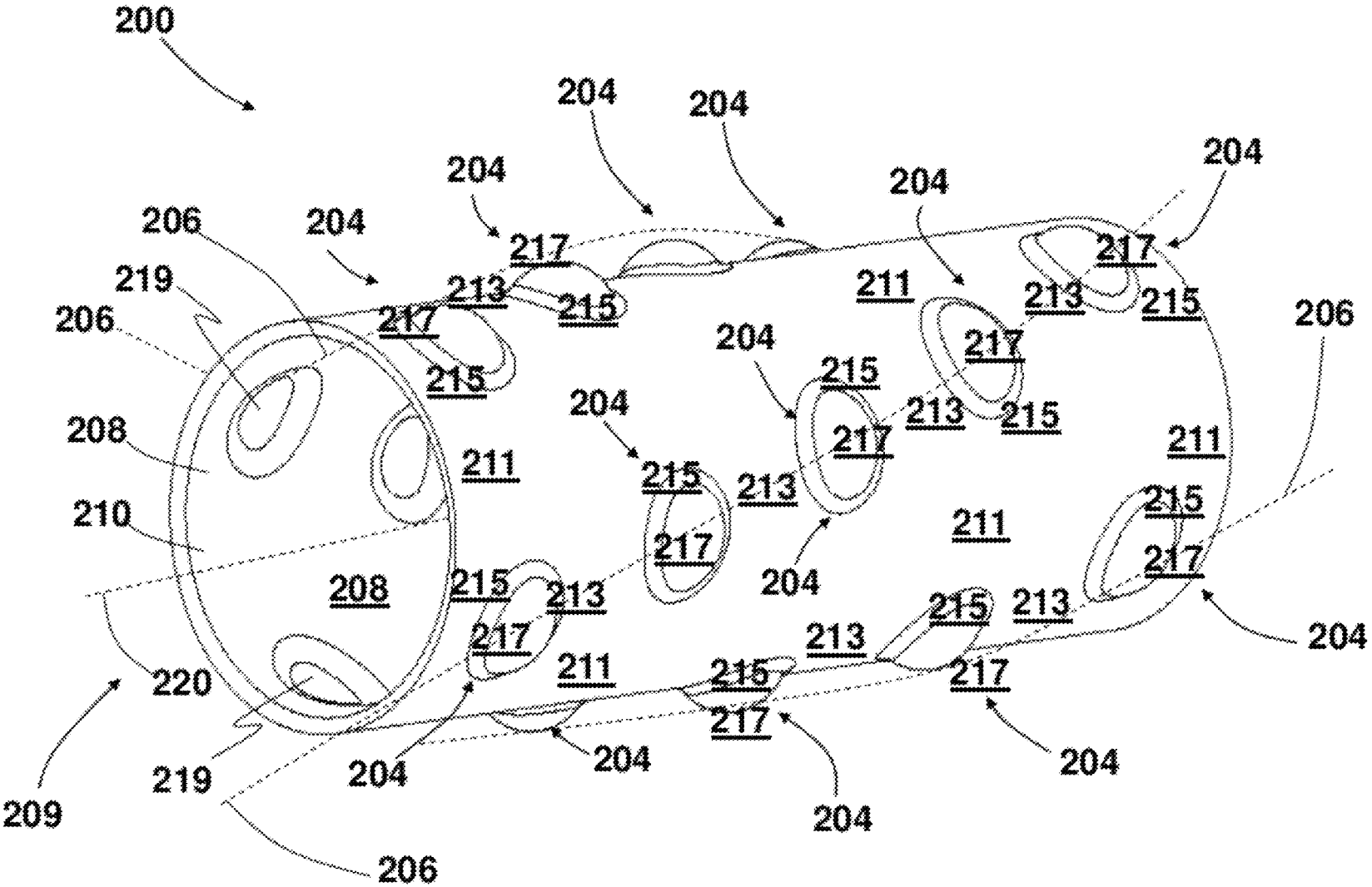
FIG. 5 is a perspective view of another embodiment of a centralizer.

FIG. 5 is a perspective view of the centralizer 200 illustrating a tubular body 209 having a plurality of protrusions 204 formed along a line 206 on an outer surface 211. As in FIG. 2, the protrusions 204 can be made using hydroforming. An opening 210 of the tubular body 209 shows a portion of an inside wall 208 opposite the outer surface 211. From the hydroforming process, a void or cavity 219, as shown in FIG. 5, is formed on the inside wall 208. The number of the plurality of protrusions 204 along the line 206 is shown as five. The number of the plurality of protrusions 204 can be more or less than five and should not be considered a limitation of the present invention. Further, the plurality of protrusions 204 can be located along a plurality of lines 206 on the outer surface 211. Here, the plurality of lines 206 is shown as four. The number of the plurality of lines 206 can be more or less than four and should not be considered a limitation of the present invention. The line 206, as previously illustrated in FIG. 2, can be straight, curved, spiral and the like.

As shown in FIG. 5, the protrusions 204 are round and include a top portion 217 and a side portion 215. The shape of any protrusion of the plurality of protrusions 204 can include the shapes as discussed under FIG. 2. The shape of the protrusion should not be considered a limitation of the present invention. Similar to FIG. 2, the top portion 217 is an expanded portion of the outer surface 211 and the underlying wall thickness is generally thinner than the wall underlying the side portion 215.

A gap region 213 is unexpanded portions of the outer surface 211 and located between adjacent protrusions 204 along the line 206. The thickness of the underlying wall at the gap region 213, like the embodiment shown in FIG. 2, is generally not expanded from hydroforming and is substantially the same as the wall thickness of the unexpanded portions of the tubular body 209. The installation and advantages of the centralizer 200 is generally the same as shown and described previously in FIG. 1 through FIG. 4.

By now it should be appreciated an improved centralizer including structure for improving the flow of cement around the centralizer is provided. Further, protrusions used to center the centralizer within a wellbore are strengthened. Further yet, on installation of the centralizer, a cement column can be provided that supports at least between the side of the wellbore and the wall adjacent to a gap region between protrusions. This can provide additional support by sharing and relieving a portion of the forces acting on the protrusions.

Although certain preferred embodiments and methods have been disclosed herein, it will be apparent from the foregoing disclosure to those skilled in the art that variations and modifications of such embodiments and methods may be made without departing from the spirit and scope of the invention. It is intended that the invention shall be limited only to the extent required by the appended claims and the rules and principles of applicable law.

I claim:

1. A device for centering a casing within a wellbore, comprising:

a generally tubular body made of metal and having an outer surface for facing the wellbore and an inner surface opposite the outer surface;

a plurality of protrusions disposed on the outer surface and each protrusion forms a cavity on the inner surface, wherein the plurality of protrusions is generally positioned along a line and individual protrusions have a first thickness between the inner and outer surfaces; and a gap region disposed between adjacent protrusions on the outer surface and generally along the line, wherein the gap region has a second thickness between the inner and outer surfaces and the second thickness is greater than the first thickness, and wherein the portions of the protrusions adjacent to the gap region are each rounded to reduce the formation of voids or snagging upon filling the gap region with cement within the wellbore such that the cement provides structural support and compensates for the reduced thickness of the protrusions.

2. The device of claim 1, wherein each protrusion of the plurality of protrusions comprises a length and a width.

3. The device of claim 2, wherein anyone of the plurality of protrusions positioned along the line comprises:

a pair of side portions along the length of each protrusion and on the outer surface;

a top portion between the pair of side portions; and a pair of end portions along the width of each protrusion and on the outer surface and adjacent to the side and top portions.

4. The device of claim 1, wherein the line is curved.

5. The device of claim 1, wherein the line is spiral.

6. The device of claim 1, wherein anyone of the plurality of protrusions forms a shape selected from the group of shapes consisting of paraboloid of revolution, ellipsoid and capsule.

7. The device of claim 1, wherein individual protrusions are configured to be cinctured with cement to support the individual protrusions.

8. The device of claim 1, wherein the first thickness includes a thinning thickness.

9. The device of claim 8, wherein the first thickness thins down from the second thickness.

10. A device for centering a casing within a wellbore, comprising:

a generally tubular body made of metal and having opposite inner and outer surfaces;

a plurality of protrusions having lengths and widths disposed substantially along a line on the outer surface and each protrusion forms a cavity on the inner surface, each protrusion having a pair of end portions and disposed on the outer surface, wherein the pair of end portions is generally along the width of the protrusion and individual protrusions have a first thickness between the inner and outer surfaces, wherein the end portions have rounded ends; and a gap region on the outer surface and generally along the line and between adjacent protrusions, wherein the end portions are adjacent to the gap region, the gap region has a second thickness between the inner and outer surfaces, and the second thickness is greater than the first thickness, wherein the rounded ends of the protrusions are configured to reduce the formation of voids or snagging upon filling the gap region with cement within the wellbore such that the cement provides structural support and compensates for the reduced thickness of the protrusions.

11. The device of claim 10, wherein the pair of end portions is generally curved.

12. The device of claim 10, wherein each protrusion of the plurality of protrusions comprise a pair of side portions disposed along the length of the protrusion.

13. The device of claim 12, wherein each protrusion of the plurality of protrusions comprises a top portion between the pairs of side and end portions.

14. The device of claim 13, wherein any top portion is a point of contact between the device and the wellbore.

15. The device of claim 12, wherein the thickness of the pairs of side and end portions are generally thinner than the generally tubular body.

16. A device for centering a casing within a wellbore, comprising:

a generally tubular body made of metal and having an outer surface for facing the wellbore and an inner surface opposite the outer surface;

a plurality of protrusions disposed on the outer surface and each protrusion of the plurality of protrusions form an underlying cavity on the inner surface, wherein the plurality of protrusions is generally positioned along a line and individual protrusions have:

(i) a first thickness between the inner and outer surfaces; and (ii) a pair of end portions, each having rounded ends; and a gap region disposed generally along the line and between adjacent protrusions, wherein the gap region:

(i) has a second thickness between the inner and outer surfaces and the second thickness is greater than the first thickness; and (ii) the rounded ends of the protrusions, which are adjacent to the respective gap regions, are configured to reduce the formation of voids or snagging upon filling the gap region with cement within the wellbore such that the cement provides structural support and compensates for the reduced thickness of the protrusions.

17. The device of claim 16, wherein the plurality of protrusions comprises a pair of end portions generally along the line and adjacent to the respective gap regions.

18. A device for centering a casing within a wellbore, comprising:

a generally tubular body made of metal and having an outer surface configured to face the wellbore and an inner surface opposite the outer surface;

first and second pluralities of protrusions disposed on the outer surface, the first plurality of protrusions is generally positioned along a first line on the outer surface, and the second plurality of protrusions is generally positioned along a second line on the outer surface and spaced from the first line, wherein individual protrusions form a cavity on the inner surface and have a first thickness between the inner and outer surfaces, and the protrusions have rounded ends;

a plurality of gap regions including at least one first gap region disposed between adjacent protrusions generally positioned along the first line and at least one second gap region disposed between adjacent protrusions generally positioned along the second line, wherein individual gap regions have a second thickness between the inner and outer surfaces and the second thickness is greater than the first thickness, wherein the rounded ends of the protrusions that define the gap region are configured to reduce the formation of voids or snagging upon filling the gap region with cement within the wellbore such that the cement provides structural support and compensates for the reduced thickness of the protrusions; and a portion of the outer surface disposed between the first and second lines, wherein the portion has a third thickness between the inner and outer surfaces.

19. The device of claim 18, wherein the third thickness is approximately equal to the second thickness.

20. The device of claim 19, wherein a combination of the second and third thicknesses cinctures the first thickness.

* * * * *